US007152264B2

(12) United States Patent
Boyd

(10) Patent No.: US 7,152,264 B2
(45) **Date of Patent: *Dec. 26, 2006**

(54) AIR MATTRESS WITH PILLOW TOP

(76) Inventor: Dennis Boyd, 14457 Rouge River, Chesterfield, MO (US) 63017

( * ) Notice: Subject to any disclaimer, the term of this patent is extended or adjusted under 35 U.S.C. 154(b) by 0 days.

This patent is subject to a terminal disclaimer.

(21) Appl. No.: 10/032,872

(22) Filed: Dec. 26, 2001

(65) Prior Publication Data

US 2002/0138910 A1 Oct. 3, 2002

Related U.S. Application Data

(63) Continuation-in-part of application No. 09/821,932, filed on Mar. 30, 2001, now Pat. No. 6,983,502.

(51) Int. Cl.
*A47C 27/08* (2006.01)
*A47C 27/18* (2006.01)

(52) U.S. Cl. ..... 5/706; 5/707; 5/709; 5/710; 5/711

(58) Field of Classification Search ..... 5/706–712, 5/713, 724, 932, 655.3, 644, 645
See application file for complete search history.

(56) References Cited

U.S. PATENT DOCUMENTS

| | | | | | |
|---|---|---|---|---|---|
| 2,604,641 | A | | 7/1952 | Reed | 5/349 |
| 3,042,941 | A | * | 7/1962 | Marcus | 5/708 |
| 3,251,075 | A | | 5/1966 | Saltness et al. | 5/337 |
| 3,644,950 | A | | 2/1972 | Lindsay, Jr. | 5/347 |
| 3,879,776 | A | * | 4/1975 | Solen | 5/665 |
| 4,225,989 | A | * | 10/1980 | Corbett et al. | 5/713 |
| 4,371,997 | A | | 2/1983 | Mattson | 5/450 |
| 4,424,600 | A | | 1/1984 | Callaway | 5/470 |
| 4,803,744 | A | * | 2/1989 | Peck et al. | 5/713 |
| 4,896,389 | A | | 1/1990 | Chamberland | 5/453 |
| 5,044,030 | A | * | 9/1991 | Balaton | 5/710 |
| 5,107,557 | A | * | 4/1992 | Boyd | 5/665 |
| 5,243,722 | A | * | 9/1993 | Gusakov | 5/655.3 |
| 5,566,408 | A | * | 10/1996 | McCarthy et al. | 5/682 |
| 5,598,593 | A | | 2/1997 | Wolfe | 5/710 |
| 5,630,237 | A | * | 5/1997 | Ku | 5/420 |
| 5,638,565 | A | * | 6/1997 | Pekar | 5/710 |
| 5,647,078 | A | * | 7/1997 | Pekar | 5/706 |
| 5,647,079 | A | * | 7/1997 | Hakamiun et al. | 5/713 |
| 5,711,041 | A | * | 1/1998 | Chen | 5/708 |
| 5,727,270 | A | * | 3/1998 | Cope et al. | 141/114 |
| 5,740,573 | A | * | 4/1998 | Boyd | 5/685 |
| 5,890,245 | A | * | 4/1999 | Klearman et al. | 5/714 |
| 6,073,291 | A | * | 6/2000 | Davis | 414/676 |
| 6,148,461 | A | * | 11/2000 | Cook et al. | 5/713 |
| 6,332,760 | B1 | * | 12/2001 | Chung | 417/411 |
| 6,568,011 | B1 | * | 5/2003 | Fisher et al. | 5/706 |
| 2003/0024050 | A1 | * | 2/2003 | Boso et al. | 5/711 |

* cited by examiner

*Primary Examiner*—Jack W. Lavinder
(74) *Attorney, Agent, or Firm*—Husch & Eppenberger LLC; Gregory E. Upchurch

(57) ABSTRACT

An air mattress includes a first inflatable compartment having a length and width, when inflated, sufficient to support a human body. The first compartment is composed of at least two layers of vinyl, one layer of vinyl forming the top of the compartment and the second forming the bottom. A second inflatable compartment extends generally the length and width of the first compartment and is attached to the first compartment through a perimeter seal that is recessed from the periphery of the air mattress. The second compartment is tufted and so contain a layer of resilient material.

15 Claims, 5 Drawing Sheets

AIR MATTRESS WITH PILLOW TOP

CROSS REFERENCE TO RELATED APPLICATIONS

This application is a continuation-in-part of application Ser. No. 09/821,932 filed Mar. 30, 2001, now U.S. Pat. No. 6,983,502.

STATEMENT REGARDING FEDERALLY SPONSORED RESEARCH OR DEVELOPMENT

Not applicable.

BACKGROUND OF THE INVENTION

This invention relates generally to air mattresses and more particularly to a air mattress with an second inflatable layer on top to provide a "pillow top" appearance and feel to the mattress.

The standard air mattress also could be improved in appearance and feel. The single vinyl top sheet of these mattresses is rather typically plain and flat in appearance, even with a pattern embossed thereon. Conventional mattresses, on the other hand, traditionally have a tufted or quilted appearance which people find attractive.

Moreover, conventional mattresses often have a different feel to the user than that achieved with conventional air mattresses. Such mattresses could be more acceptable with a better feel.

SUMMARY OF THE INVENTION

Among the various features of the present invention may be noted the provision of an air mattress in which the comfort is improved.

Another feature is the provision of such a air mattress with an improved appearance.

A third feature is the provision of such a air mattress with increased versatility.

Other objects and features will be in part apparent and in part pointed out hereinafter.

Briefly, in its broadest aspect an air mattress of the present invention includes a first inflatable compartment having a length and width, when inflated, sufficient to support a human body. The first compartment has a top, a bottom, and sides and is composed of at least two layers of vinyl, one layer of vinyl forming the top of the compartment and the second forming the bottom. The mattress also includes a second inflatable compartment disposed on the top of the first inflatable compartment and secured thereto through a perimeter seal that is recessed from the periphery of the inflatable compartments. The second compartment extends generally the length and width of the top of the first compartment and is of a size, when inflated, sufficient to support a human body. The second compartment is tufted and may also contain a layer of resilient material that may be incorporated into the air mattress in combination with or in alternative to the recessed perimeter seal.

BRIEF DESCRIPTION OF THE DRAWINGS

Similar reference characters indicate similar parts throughout the several views of the drawings.

DESCRIPTION OF THE PREFERRED EMBODIMENTS

Figure 1:
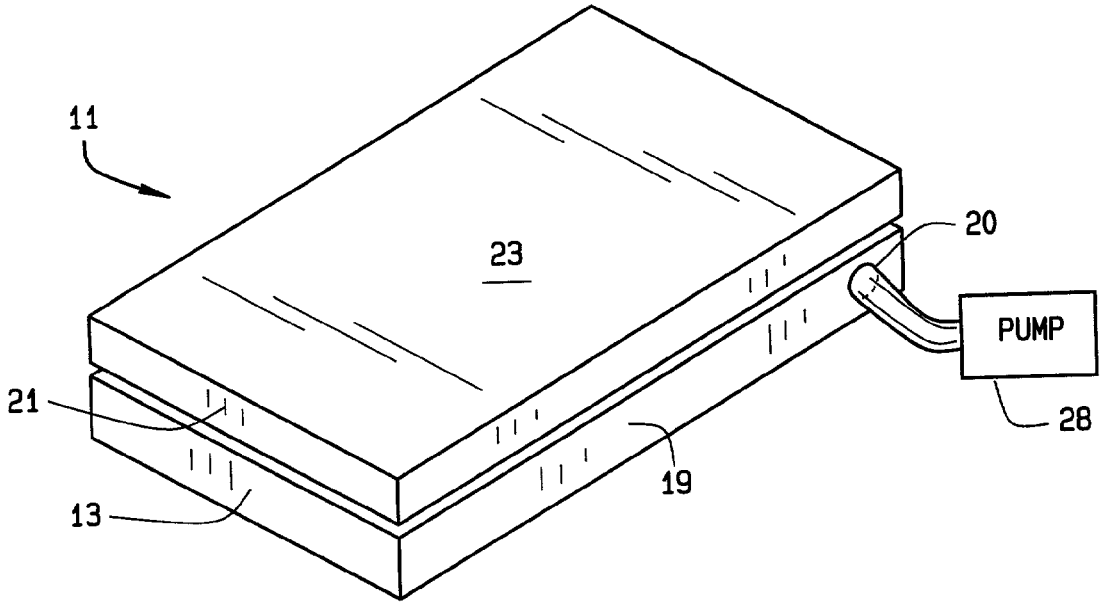
FIG. 1 is a perspective view illustrating the air mattress of the present invention.
Figure 2:
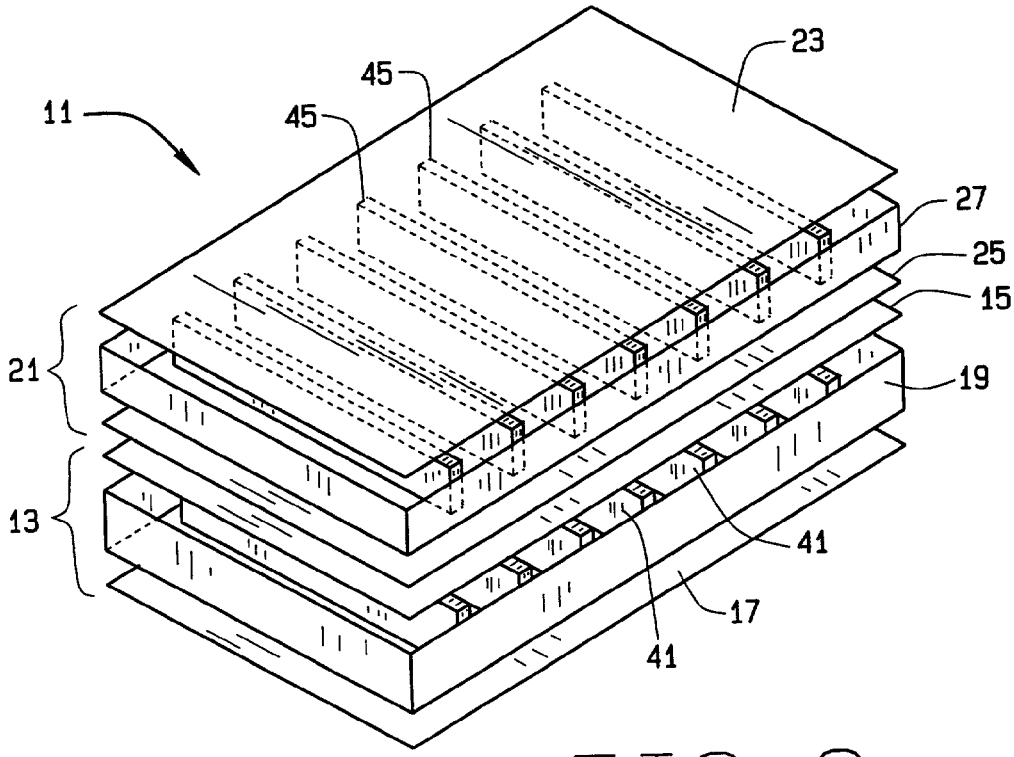
FIG. 2 is an exploded perspective view of the air mattress of FIG. 1.

Turning to the drawings and more specifically to FIGS. 1 and 2, an air mattress 11 of the present invention includes a first inflatable compartment 13 having a length and width, when inflated, sufficient to support a human body. Compartment 13 is composed of a first vinyl sheet 15 forming a top of the compartment, a second vinyl sheet 17 forming a bottom of the compartment, and a vinyl strip 19 forming the sides of the compartment. Preferably the first inflatable compartment 13 may be inflated by means of a standard inflate, or inflate/deflate, valve 20 disposed at a convenient location in the wall of compartment 13.

Figure 3:
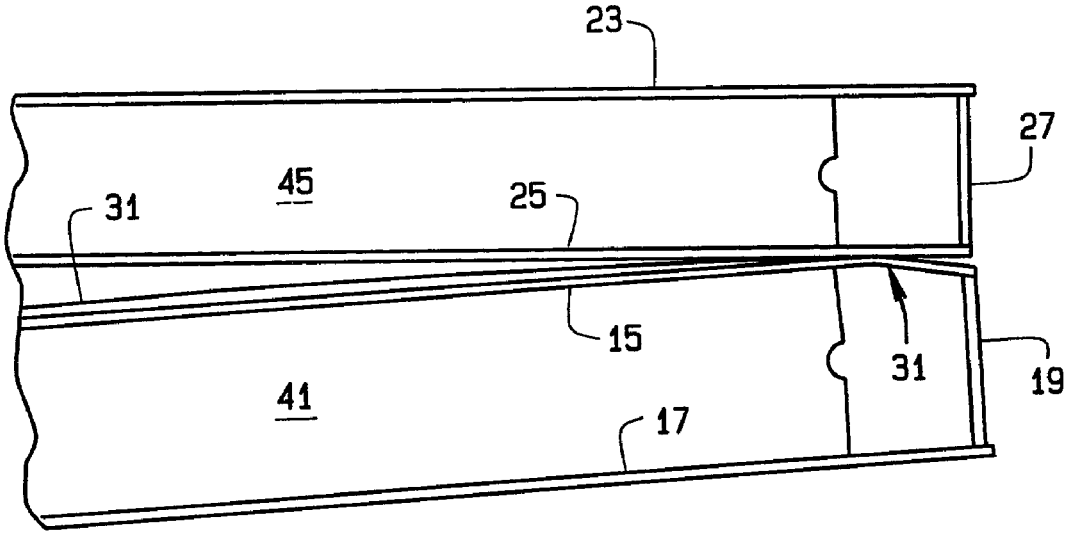
FIG. 3 is a partial sectional view, with parts broken away for clarity, of the air mattress of FIG. 1.
Figure 4:
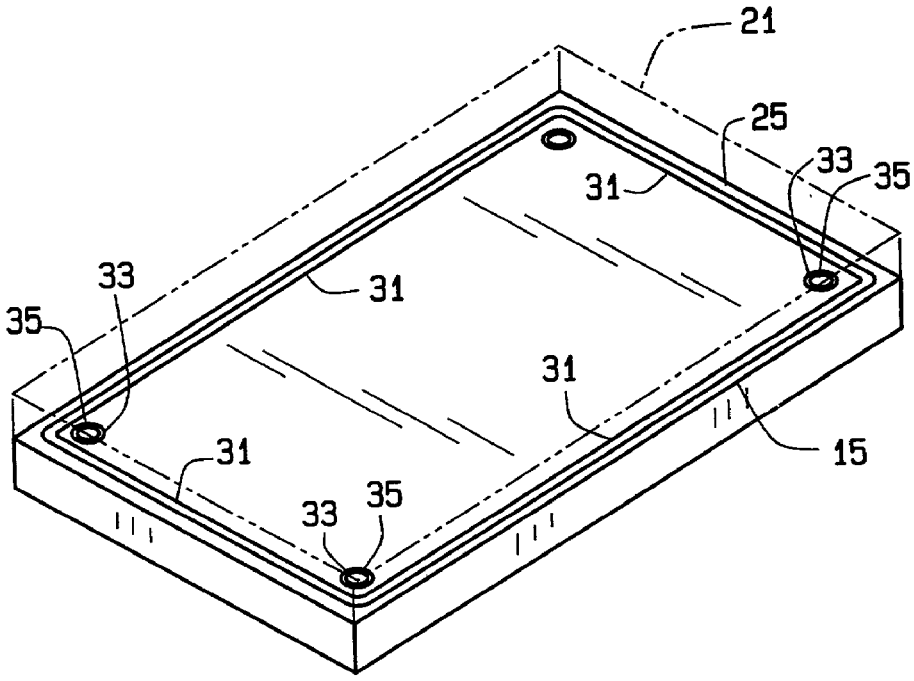
FIG. 4 is a perspective view of a portion of the air mattress of the present invention, showing the seal between the top and bottom compartments of the air mattress.

Air mattress 11 also includes a second inflatable compartment 21 disposed on the top of the first inflatable compartment 13 and secured thereto at least along a portion of the first inflatable compartment (as is shown in FIGS. 3 and 4). Second compartment 21 extends generally the length and width of the top 15 of the first compartment and is of a size, when inflated, sufficient to support a human body.

The second compartment 21 is composed of a first vinyl layer 23 forming the top of the second compartment, a second vinyl layer 25 forming the bottom of the second compartment, and a vinyl strip 27 forming the sides of the second compartment. The second compartment is inflatable to give the top of the air mattress a soft, pillow-like appearance and feel. It is preferred that the top of second compartment 21 include a soft, non-vinyl fabric or surface secured thereto. The pillow top of the second compartment 21 is tufted, as particularly described below with reference to FIGS. 5A–5E (tufting not illustrated in FIG. 1).

FIG. 1 also shows an optional pump 28 that may be used to inflate or inflate/deflate the compartments. The pump may be attached permanently to valve 20, if desired, or may be attached temporarily to the valve by the user.

As can be seen more clearly in FIGS. 3 and 4, the first and second compartments are secured together along, but spaced inwardly from, the perimeter. This is shown most clearly in FIG. 4 where the perimeter seal is labeled 31. For example, the perimeter seal 31 may be recessed approximately one inch from the edge of the mattress. This seal connects the top vinyl layer 15 of the first compartment to the bottom vinyl layer 25 of the second compartment. In addition, the compartments are sealed together (at seals 33) adjacent a plurality of holes 35 that provide fluid communication channel connecting the first and second compartments. Of course, if desired, the first and second compartments should also be secured together at other places. The seals may be formed using any known sealing method.

It is preferred that the compartments have a single inflation/deflation valve 20, and that (in the embodiment shown in FIG. 1) the inflation air for the second compartment flow initially into the first compartment. Of course, the single inflation/deflation valve could be disposed in a wall of the second compartment instead, in which case inflating air flow would be from the second compartment to the first.

As can be seen in FIGS. 2 and 3, the vinyl layers of the first compartment are held together along the perimeter by vinyl strip 19 and internally by a plurality of spaced ribs 41. Ribs 41 are preferably formed of vinyl, extend transversely across the compartment, and are sealed to the vinyl layers of the first compartment along their length. The ribs are preferably notched on each end as shown in FIG. 3 and terminate short of seal 31. This provides for air flow around the ribs and permits the portions of the compartments outboard of the seal 31 to flex relatively independently of each other.

Similarly, second compartment 21 includes a plurality of ribs 45 that serve the same functions for the second compartment that ribs 41 serve for the first compartment. It is preferred that first compartment 13 be somewhat taller, when inflated, than second compartment 21. For this reason, ribs 41 are preferably taller than ribs 45. For example, ribs 41 can be approximately four inches in height, while ribs 45 would be approximately three includes in height. Other dimensions could of course be used.

The construction of air mattress 11 as shown in the drawings leaves the first and second compartments substantially free to move with respect to each other except at their periphery. Specifically, sealing the compartments together substantially only along the exterior portion allows the inner portions of the compartments to move substantially with respect to one another, thereby improving the feel of the mattress. Similarly, the fact that the primary seal 31 is recessed from the periphery of the two compartments permits limited relative movement of the second compartment with respect to the first compartment along the edge of the mattress.

Figure 5A:
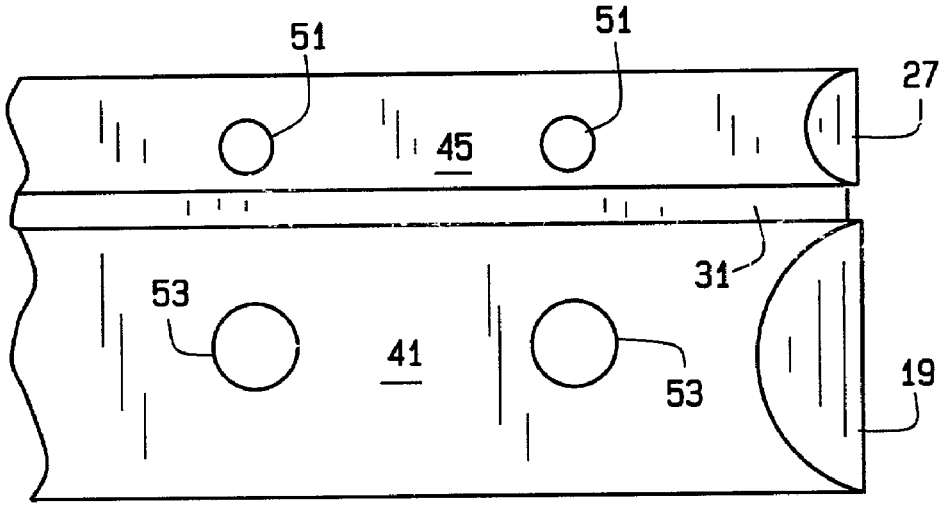
FIGS. 5A–5E show variations in the pillow top of the present invention.
Figure 5B:
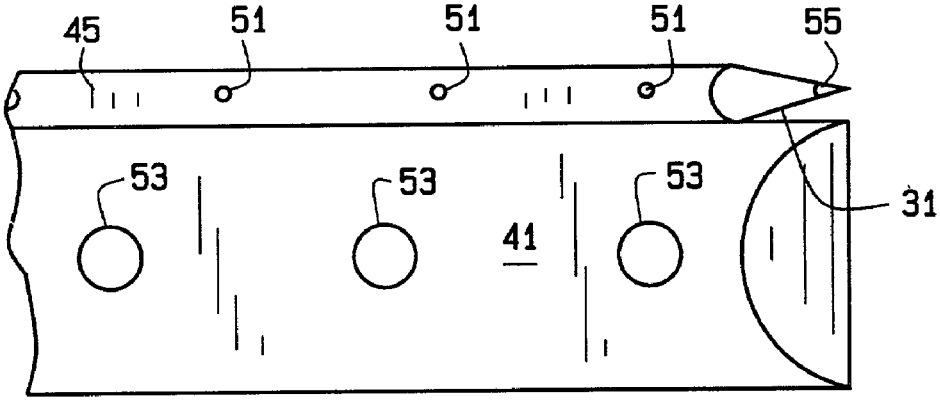
Figure 5C:
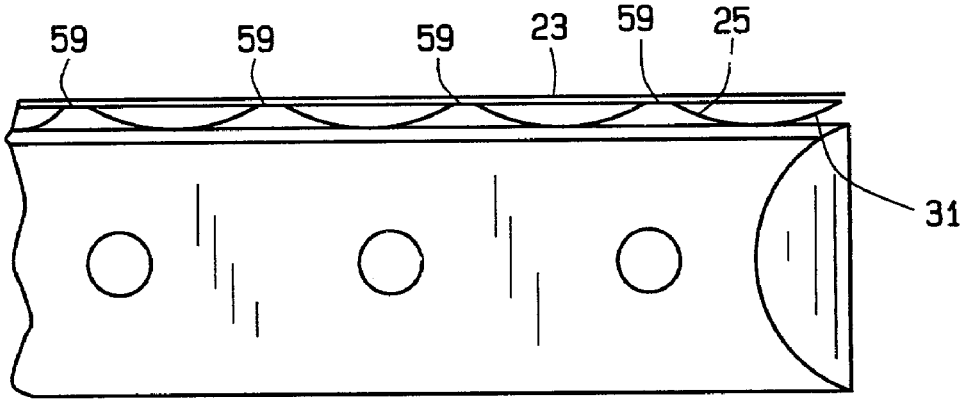

Turning to FIGS. 5A–5C, there are shown certain variations in the pillow top of the present invention. FIG. 5A illustrates in simplified form the construction of FIG. 3, with the addition of a plurality of holes 51 and 53 through ribs 45 and 41 respectively. These holes provide increased airflow back and forth in the two compartments. It should be appreciated that the second compartment in this construction has two seams and forms a gusset.

FIG. 5B illustrates a similar construction in which the top (second) compartment is constructed with a seam 55 in its vertical wall. This construction provides a more two dimensional pillow top appearance (as opposed to the three-dimensional effect of the construction of FIG. 5A). Similarly, FIG. 5C illustrates another two-dimensional-type construction in which the top layer 23 of second compartment 21 and the bottom layer 25 of that compartment are joined together by discontinuous seals 59. For example, each seal could be a circle, or could run for only a few inches or so. Air in the second compartment in this construction flows around the seals 59. This construction provides a pleasing, tufted appearence to the pillow top of the mattress. Other constructions may include seaming patterns that provide a quilted appearance, such as a continuous sinusoidal pattern.

Figure 5D:
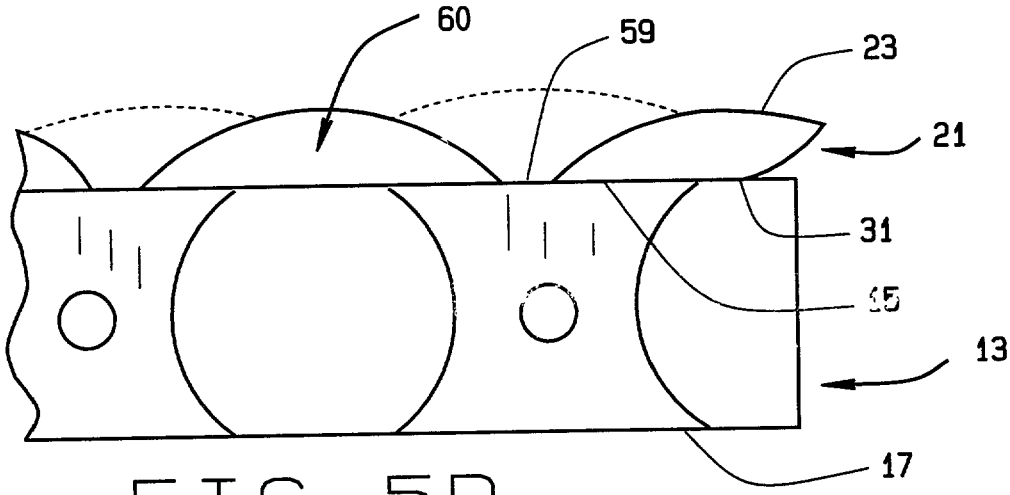

FIG. 5D illustrates a construction that combines elements from the constructions in FIGS. 5B and 5C using a number of seals between the first compartment and the second compartment. In particular, the discontinuous seals 59 can attach the first vinyl layer 23 of the second compartment 21 directly to the first compartment 13. In this construction, the vinyl sheet 15 acts as a boundary surface 60 between the compartments. The wall seal 55 may be formed in the first vinyl layer between the discontinuous seals 59 and the recessed perimeter seal 31 to provide the two-dimensional pillow top appearance. Alternatively, a separate sheet of material may connect the vinyl layer 23 to the boundary surface 60.

Figure 5E:
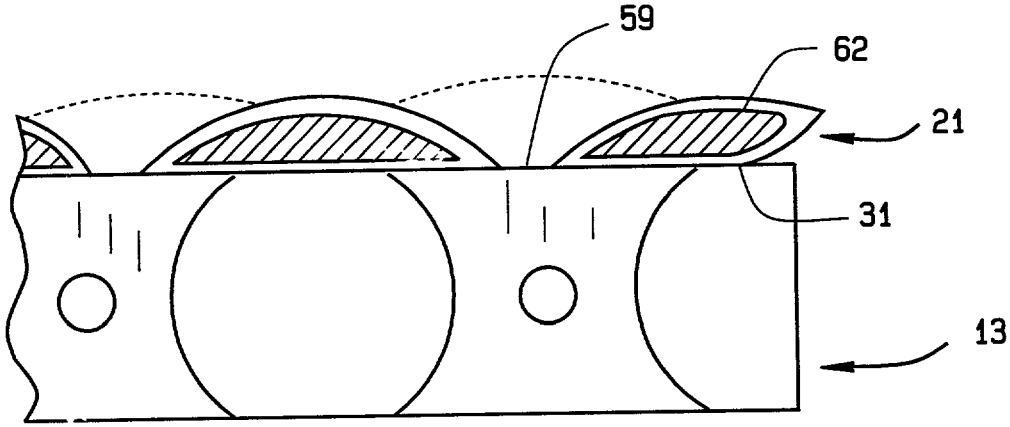

FIG. 5E illustrates a construction that incorporates a layer of cushioning material 62 to the second compartment 21, further enhancing the pillow-like appearance and feel of the air mattress 11. The layer of cushioning material 62 may be incorporated into the air mattress 11 in combination with or in lieu of the recessed perimeter seal 31. The layer of cushioning material 62 is preferably formed from a resilient material, such as foam, and other materials may be used for the layer of cushioning material 62, such as gels and liquids (especially water).

As discussed with respect to the preceding pillow top constructions and in the following embodiments of the air mattress 11, the second compartment 21 is tufted. Tufts in the second compartment can be formed by a number of devices, including the ribs 45, seals 59 and seaming patterns discussed above as well as other attachments that are discussed below. Accordingly, the tufted second compartment 21, the recessed perimeter seal 31, and the layer of material 62 each enhances the pillow top effect for the air mattress 11.

Figure 6:
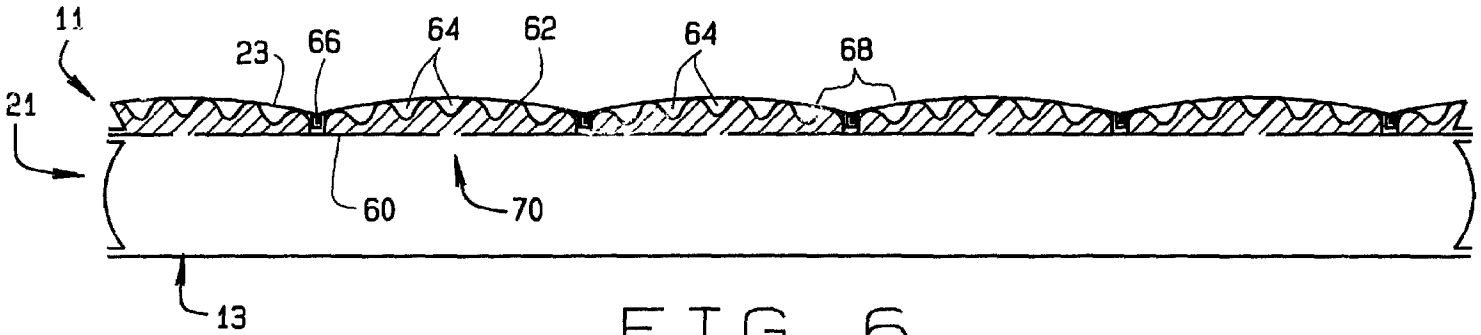
FIG. 6 is a cross-sectional view of a second embodiment of the present invention.

A second embodiment of the present invention is depicted in FIG. 6, which shows a lengthwise, cross-sectional view of the air mattress 11 with a layer of cushioning material 62, preferably a resilient foam material, within the second inflatable compartment 21. It is particularly noted that there is no layer of cushioning material in the first inflatable compartment 13. Cushioning material 62 is in addition to air that is used to inflate the compartment and does not include the attachment devices. The material 62 partially fills the second inflatable compartment 21, leaving a plurality of air spaces 64.

A connecting element 66 is disposed within a channel 68 in the second inflatable compartment 21. Although connecting element 66 is depicted as a C-shaped length of material in this embodiment, various other forms are also within the scope of the present invention, including the seals 59 and ribs 45 discussed above. A plurality of channels 68 and elements 66 are spaced across the second inflatable compartment 21, extending between the top layer 23 and the boundary surface 60. As discussed above, the boundary surface 60 is one of the two layers forming the first inflatable compartment 13. A plurality of passageways 70 are preferably distributed across the extent of boundary surface 60 at locations between the elements 66 or seals 59. The passageways 70 provide fluid communication channels enabling airflow between the compartments.

Figure 7:
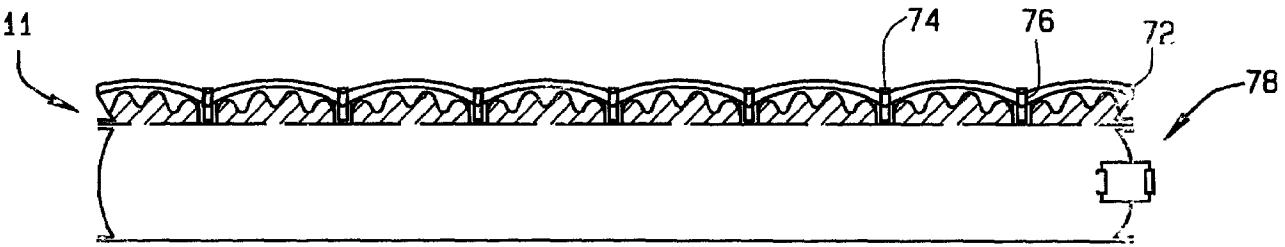
FIG. 7 is a cross-sectional view of a third embodiment of the present invention.

A third embodiment of the present invention is depicted in FIG. 7, which shows a cross-sectional view the air mattress 11 with an additional topmost surface 72 that provides a substantially level sleeping surface for improved occupant comfort. A plurality of fasteners 74 attach a plurality of supports 76 to surface 72. Supports 76 maintain the height of surface 72 above the channels 68. A valve 78 is shown in the vinyl strip 19 that forms the sides of the compartment. The valve 78 may be a one-way valve that is biased open based on a pressure difference or a two-way valve that can be used to inflate and deflate the air mattress 11.

Figure 8:
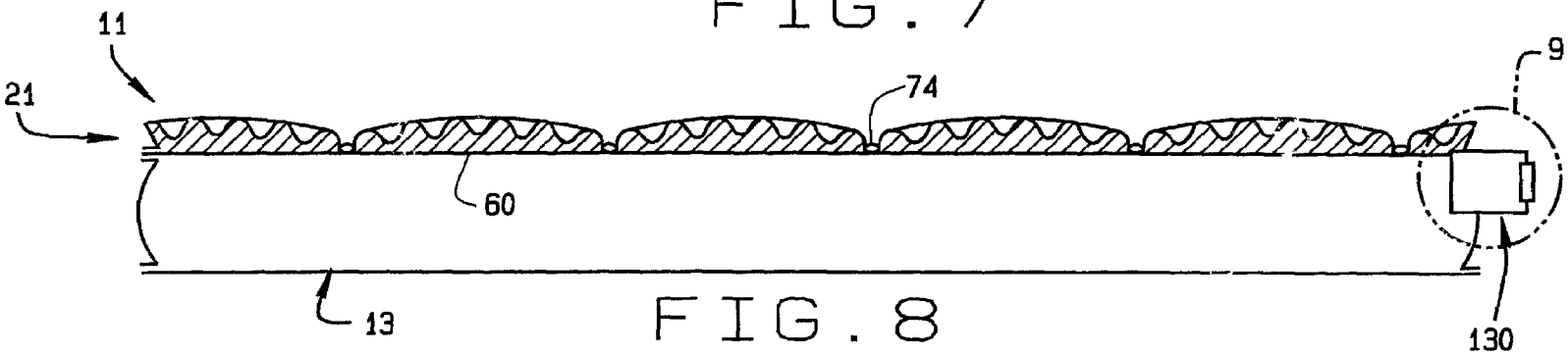
FIG. 8 is a cross-sectional view of a fourth embodiment of the present invention.

A fourth embodiment of the present invention is depicted in FIG. 8, which shows a lengthwise, cross-sectional view of an air mattress 11 with a shift valve 130 that controls the inflation of the compartments 13, 21. A plurality of fasteners 74 directly attach the first vinyl layer 23 to the boundary surface 60 between the compartments 13, 21.

Figure 9:
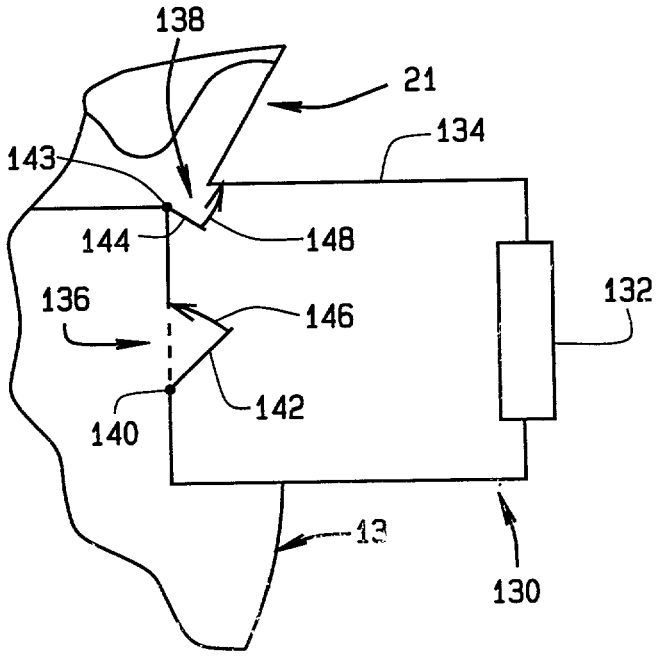
FIG. 9 is an expanded cross-sectional view of the portion of the fourth embodiment within the dashed circle 9 in FIG. 8.

FIG. 9 is a cross-sectional, expanded detail view of shift valve 130 and the portion of air mattress 11 within circle 9 in FIG. 8. A port 132 allows air to enter and exit an interior volume 134 of shift valve 130. Airflow between valve interior 134 and the first inflatable compartment is through selectively closable aperture 136. Airflow between valve interior 134 and the second inflatable compartment 21 is through selectively closable aperture 138. Hinged on a pivot 140, a rotatable door 142 opens and closes opening 136 under direction of a control means (not shown). Hinged on a pivot 143, a rotatable door 144 similarly opens and closes opening 138 under direction of a control means (not shown). The pivoting motions of doors 142 and 144 are shown by arrows 146 and 148, respectively.

Shift valve 130, as depicted, is merely illustrative of one form of a switchable valve. Numerous varieties of shift valves are well known and may be used in the present invention without departing from the scope of the present invention. The shift valve 130 is depicted with both doors 142 and 144 open to produce a common inflation pressure in the compartments 13, 21. Valve 130 may also operate with one door closed and one open to produce different pressures in the compartments 13, 21.

It should be appreciated that the air mattress of the present invention may be constructed in various sizes and shapes. It may be packaged and sold or stored in a bag, if desired.

In view of the above it will be seen that the various objects and features of the invention are achieved and other advantageous results obtained. The examples contained herein are merely illustrative and are not intended in a limiting sense. In particular, although vinyl material is particularly described for each of the layers in the inflatable compartments, other materials may also be used as long as the outer layers of the air mattress are impermeable to the passage of air (i.e., airtight). The scope of the present invention is further envisioned as encompassing subdivisions of any of the compartments into separately inflatable sections as is well known in the art. Additionally, these separately inflatable sections may be connected by open or selectively restrictable air passageways, as described previously, or may be entirely closed to the exchange of air. There may also be a single switchable valve assembly to control the airflow to or from a plurality of sections or there may be individual valves for each section.

What is claimed is:

1. An air mattress comprising:

a first inflatable compartment having a first layer, a second layer, a strip extending from the first layer to the second layer such that the strip defines substantially straight, vertically extending sides defining a height of the first inflatable compartment, and a periphery defining a length and a width, said strip forming an air-impervious wall of the first inflatable compartment;

a second inflatable compartment having at least one additional layer and extending generally said length and width of said periphery, said second inflatable compartment being tufted, said second inflatable compartment having a vertical extent substantially less than the height of the first inflatable compartment; and a perimeter seal connecting said first inflatable compartment to said second inflatable compartment, wherein said perimeter seal is recessed from said periphery;

wherein said second layer forms a boundary surface between said first inflatable compartment and said second inflatable compartment and contains a plurality of fluid communication channels between said first compartment and said second compartment, said fluid communication channels providing fluid communication between the first and second inflatable compartments to enable fluid in one of the first and second inflatable compartments to flow into the other of the first and second inflatable compartments.

2. The air mattress as set forth in claim 1, wherein said second inflatable compartment further comprises a second additional layer between said one additional layer and said first inflatable compartment, said second additional layer being sealed to said second layer of said first inflatable compartment adjacent to said plurality of fluid communication channels.

3. The air mattress as set forth in claim 1, wherein said second inflatable compartment further comprises a plurality of discontinuous seals.

4. The air mattress as set forth in claim 1, wherein said second inflatable compartment further comprises a plurality of attachments.

5. The air mattress as set forth in claim 1, further comprising a layer of cushioning material within said second inflatable compartment.

6. The air mattress as set forth in claim 5, wherein said layer of cushioning material is selected from the group consisting of foams, gels, and liquids.

7. The air mattress as set forth in claim 1, further comprising a valve between said first inflatable compartment and said second inflatable compartment.

8. The air mattress as set forth in claim 1, further comprising a valve in said first inflatable compartment.

9. The air mattress as set forth in claim 8, further comprising a pump connected with said valve.

10. An air mattress comprising:

a first inflatable compartment having a first layer, a second layer, and sides with a length and a width and defining a periphery, the sides being formed by a substantially straight, vertically extending strip extending from the first layer to the second layer, said strip being air-impervious;

a second inflatable compartment having at least one additional layer and extending generally the length and width of the periphery, said second inflatable compartment being tufted, said first and second inflatable compartments having substantially different heights;

a plurality of ribs extending from the first layer to the second layer of the first compartment;

a perimeter seal connecting said first inflatable compartment to said second inflatable compartment, wherein said perimeter seal is spaced a distance from the periphery; and a fluid communication channel between said first inflatable compartment and said second inflatable compartment, said fluid communication channels providing fluid communication between the first and second inflatable compartments to enable fluid in one of the first and second inflatable compartments to flow into the other of the first and second inflatable compartments.

11. The air mattress as set forth in claim 10, wherein said second inflatable compartment further comprises a plurality of discontinuous seals.

12. The air mattress as set forth in claim 11, further comprising a layer of cushioning material within said second inflatable compartment.

13. The air mattress as set forth in claim 12, wherein said layer of cushioning material is selected from the group consisting of foams, gels, and liquids.

14. An air mattress comprising:

a first inflatable compartment having a first layer, a second layer, a strip extending from the first layer to the second layer such that the strip defines sides, the length of the strip defining a height of the first inflatable layer, and a periphery defining a length and a width, said strip being air-impervious;

a second inflatable compartment having at least one additional layer and extending generally said length and width of said periphery, said second inflatable compartment being tufted, said second inflatable compartment having a vertical extent substantially less than the height of the first inflatable compartment; and a layer of cushioning material in one of said first inflatable compartment and said second inflatable compartment, wherein the other of said first inflatable compartment and said second inflatable compartment is inflated but does not contain a layer of cushioning material;

wherein said second layer forms a boundary surface between said first inflatable compartment and said second inflatable compartment and contains a plurality of fluid communication channels between said first compartment and said second compartment, said fluid communication channels providing fluid communication between the first and second inflatable compartments to enable fluid in one of the first and second inflatable compartments flow into the other of the first and second inflatable compartments;

wherein said second inflatable compartment further comprises a second additional layer between said one additional layer and said first inflatable compartment, said second additional layer being sealed to said second layer of said first inflatable compartment adjacent to said plurality of fluid communication channels.

15. The air mattress as set forth in claim 14, further comprising a perimeter seal connecting said first inflatable compartment to said second inflatable compartment, wherein said perimeter seal is recessed from said periphery.

* * * * *